United States Patent [19]

Boser et al.

[11] 4,187,792

[45] Feb. 12, 1980

[54] THREAD TRIMMER

[75] Inventors: Ronald J. Boser, Dix Hills, N.Y.; Walter P. Siegel, Lebanon, N.J.; Michael F. Picciotti, Jackson Heights, N.Y.

[73] Assignee: Union Special Corporation, Chicago, Ill.

[21] Appl. No.: 890,346

[22] Filed: Mar. 27, 1978

[51] Int. Cl.[2] ..... D05B 65/00

[52] U.S. Cl. ..... 112/286; 112/292; 112/300

[58] Field of Search ..... 112/291, 285, 286, 292, 112/300, 255, 130

[56] References Cited

U.S. PATENT DOCUMENTS

| | | | |
|---|---|---|---|
| 2,941,010 | 11/1959 | Cohen. | |
| 3,424,116 | 1/1969 | Von Hagen. | |
| 3,524,420 | 8/1970 | Peschke. | |
| 3,624,735 | 11/1971 | Hedegeraard | 112/292 |
| 3,776,161 | 12/1973 | Papajewski | 112/292 |
| 3,847,102 | 11/1974 | Rogner | 112/286 |
| 3,894,502 | 7/1975 | Hager | 112/300 X |
| 3,935,827 | 2/1976 | Winter | 112/292 |
| 3,960,098 | 6/1976 | Papajewski et al. | 112/286 |
| 4,077,342 | 3/1978 | Steckenrider | 112/292 |

*Primary Examiner*—Ronald Feldbaum

[57] ABSTRACT

Herein disclosed is a below the throat plate thread trimmer which is moved in a path from the right side of the rotary hook assembly, up and over it and then downwardly to the left of it. The path being in the nature of a compound angle whereby elements of the thread cutter portion pass into the needle thread loop at a most advantageous angle. After securing and separating the bobbin thread and respective legs of the needle thread loop, the thread trimmer is moved to position directly below the needle hole. While in this position the bobbin thread and one leg of the needle thread loop are cut.

6 Claims, 14 Drawing Figures

FIG. 2
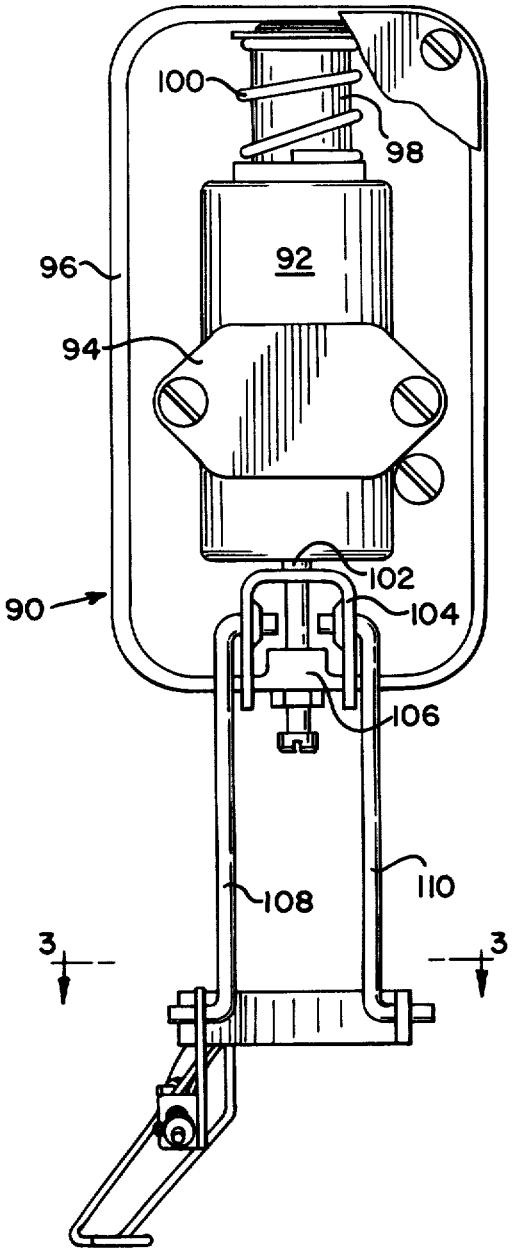
FIG. 3
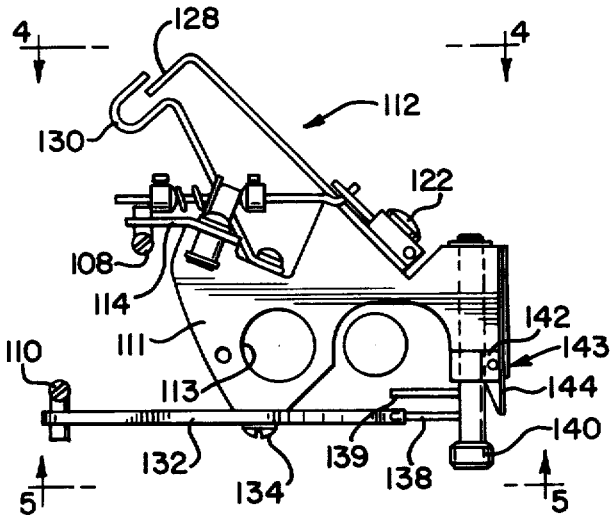
FIG. 5
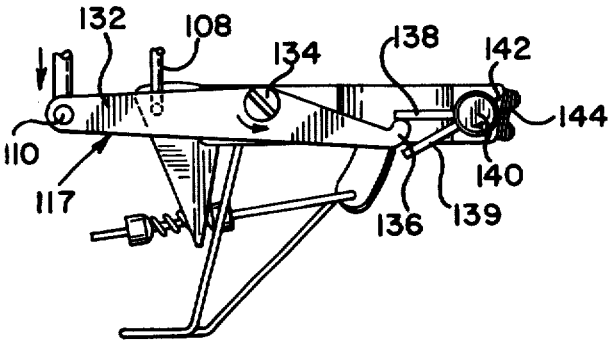
FIG. 7
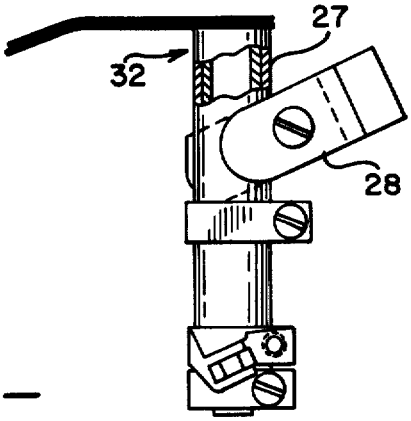
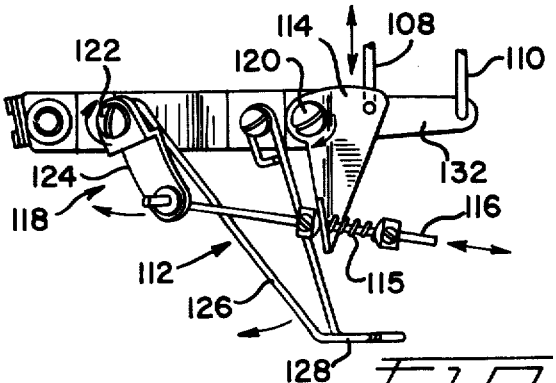
FIG. 4

FIG. 14
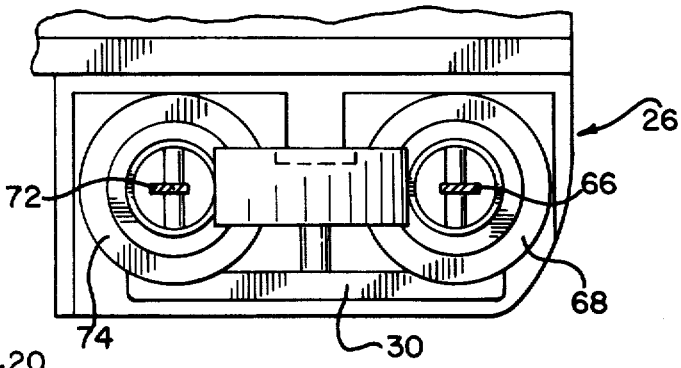
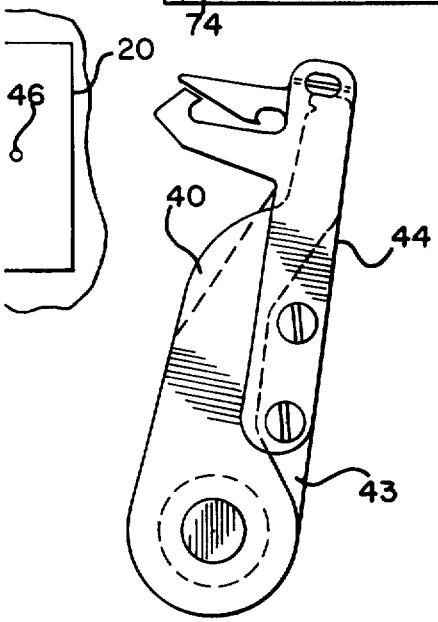
FIG. 10
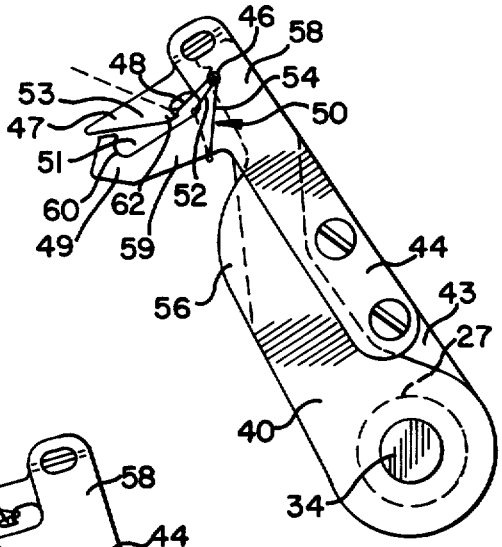
FIG. 11
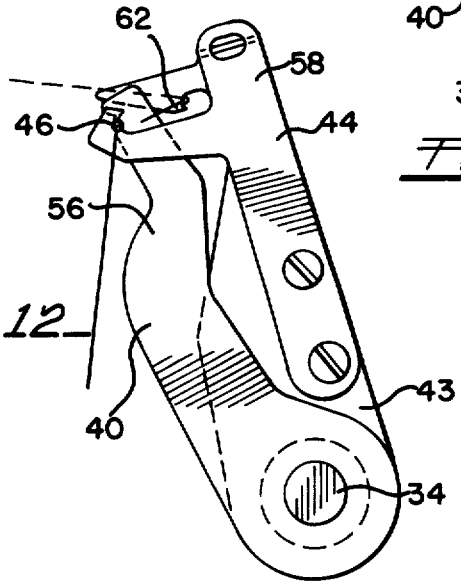
FIG. 12
FIG. 13
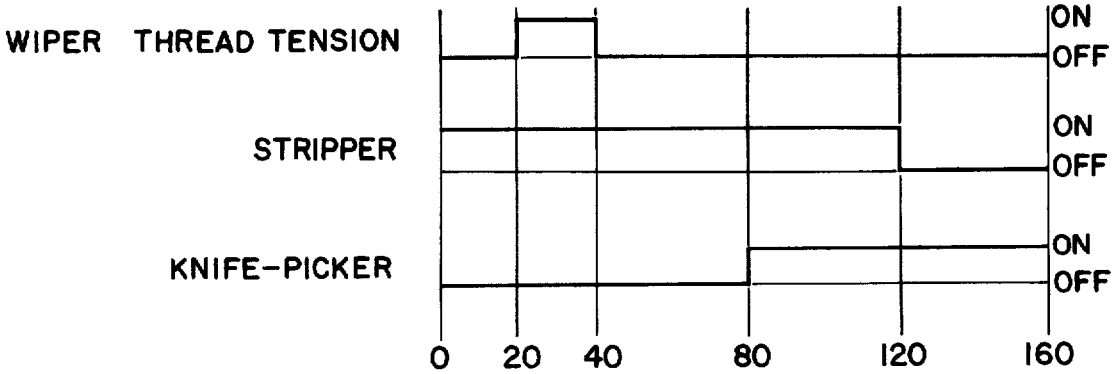

THREAD TRIMMER

The present invention relates to thread trimmers generally and more particularly to a below the throat plate thread trimmer in cooperation with a needle feed type sewing machine. That is a type of trimmer in which there is limited space below the throat plate in the area of stitch formation.

The practice of cutting the thread, involved in the stitch forming process, below the throat plate is well known. Additionally, it is understood that the space limitations available wherein the process can be accomplished varies from particular machine class to particular machine class. Some of these classes, such as a drop feed, needle feed, for example, because of the various elements unique to each, have severe space limitation wherein to perform the thread cutting and related functions. Additionally, in the two classes mentioned, which are basically known as lockstitch machines, there are additional problems in that the cutting cycle must be initiated at a particular time during the formation of the stitch. This is to insure that the proper threads can be intercepted, separated, and cut while specific lengths of bobbin thread and needle thread are being made available to begin the next sewing cycle.

There are a number of devices designed to perform these functions. However, for one reason or another, these devices suffer from one or more inadequacies. Such as, for example, the length of the thread tail left affixed to the sewn fabric, the thickness or weight of the thread which they are capable of cutting, the fact that during their cutting cycle they initiate a bobbin overspin and their overall unreliability to perform the proper cutting cycle over sustained periods of time. As stated above, these problems are compounded when the particular type of machine, in order to function properly, creates severe space limitations in the area of the needle hole.

Therefore, it is an object of this invention to provide a thread severing assembly which after securing and separating the desired thread cuts a predetermined number thereof at a point directly adjacent and below the needle hole.

Another object of this invention is to provide a thread severing assembly which actuates a particular number of elements thereof through a compound angle.

Still another object of this invention is to provide a thread severing assembly that includes a particular device which is driven through a compound angle whereby it enters the needle thread loop while passing under the throat plate and over the top of the hook assembly.

Another object of this invention is to provide a thread cutting assembly which includes a shock dampening means whereby during the thread cutting portion of the work cycle, bobbin overspin is greatly reduced.

Yet another object of this invention is to provide a thread cutting assembly for a lockstitch sewing machine wherein particular elements thereof are driven along a path from the right of the hook up over the hook and then down into the needle thread loop.

Another object of this invention is to provide a thread cutting assembly which can be moved upwardly or downwardly to cooperate with the space available between the throat plate and other elements of the sewing machine therebelow.

But another object of this invention is to provide a thread cutting assembly which is capable of cooperation with a wide range of thread thicknesses or weights.

And, still another object of this invention is to provide a thread cutting assembly which draws off the necessary thread from the bobbin whereby the next sewing cycle can be successfully initiated.

According to the present invention there is provided a thread severing assembly which includes: a thread stripper means, a knife means, a picker means, and a support and driving means. Employed in combination therewith is a thread tensioning means for controlling the removal of thread from the thread cone and a thread wiper means with which after the cutting cycle moves the severed needle thread leg to a predetermined position. In a preferred embodiment, the stripper means, picker means and knife means are of a flat elongated nature, and are, when not engaged in the thread cutting cycle, housed in a position to the right of the stitch forming instrumentality. Upon engagement of the driving means the picker means, stripper means, and knife means sweep in a path in the nature of an arc having at least a compound angle. The path of the arc is such that the elements come up from the right side of the rotary hook then between the top thereof and the bottom of the throat plate. As the elements pass beyond the needle hole the picker curves downwardly and enters the loop of the needle thread as it is being formed by the hook. Prior to this time the thread tensioning means has secured the needle thread whereby withdrawal from the cone is prevented. The needle thread loop then forms around the picker while it is thus at the extreme extent of its travel. The bobbin thread during this time, has been separated such that it is adjacent to the leg of the needle thread loop to be severed. Thereafter the picker is withdrawn to the right and upwardly until the threads to be severed are tensioned and at a point at the centerline of the needle directly under the needle hole. During the period of withdrawal the stripper means strips the thread along the picker means, and when below the needle hole, the knife moves against it which cuts the threads. The thread wiper means next, sweeps the cut needle thread into a predetermined location. The entire thread severing assembly then moves back to its initial position whereby the next sewing cycle can be initiated. At the beginning of the next sewing cycle the thread tension means is disengaged.

The above and other objects, features and advantages of the present invention will become more apparent from the following description of one preferred embodiment thereof taken in conjunction with the accompanying drawings.

In the drawings:

FIG. 2 is a plan view illustrating the thread wiper and tensioning portion of the invention as shown generally in FIG. 1.

FIG. 3 is a view taken along lines 3—3 of FIG. 2.

FIG. 4 is a view taken along lines 4—4 of FIG. 3.

FIG. 5 is a view taken along lines 5—5 of FIG. 3.

FIG. 7 is a plan view illustrating the thread cutter of FIG. 6.

FIG. 10 is a plan view depicting the thread stripper means, knife means and picker means prior to actuation.

FIG. 11 shows the assembly after the interception of the threads.

FIG. 12 shows the assembly at the point where the predetermined threads are cut.

FIG. 13 is a timing chart showing the timing of a number of elements, and

FIG. 14 is a view taken along lines 14—14 of FIG. 9.

Figure 6:
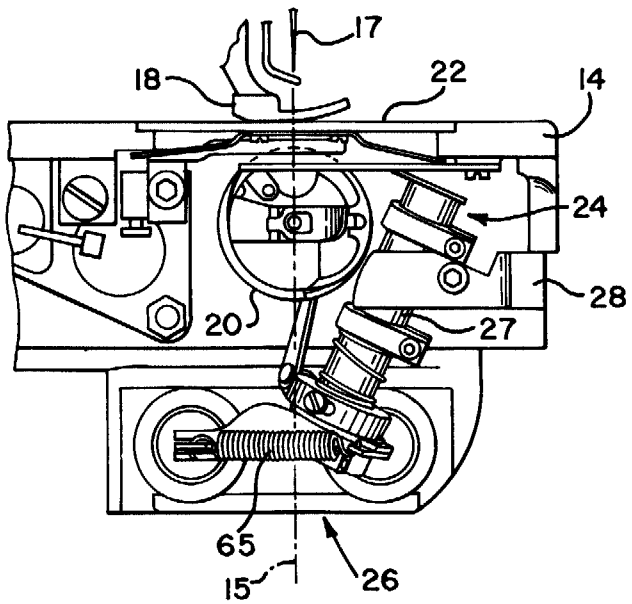
FIG. 6 is a fragmentary vertical cross section view taken from the left of FIG. 1 through the bed and throat plate of the lockstitch sewing machine showing therein the thread trimmer assembly.
Figure 1:
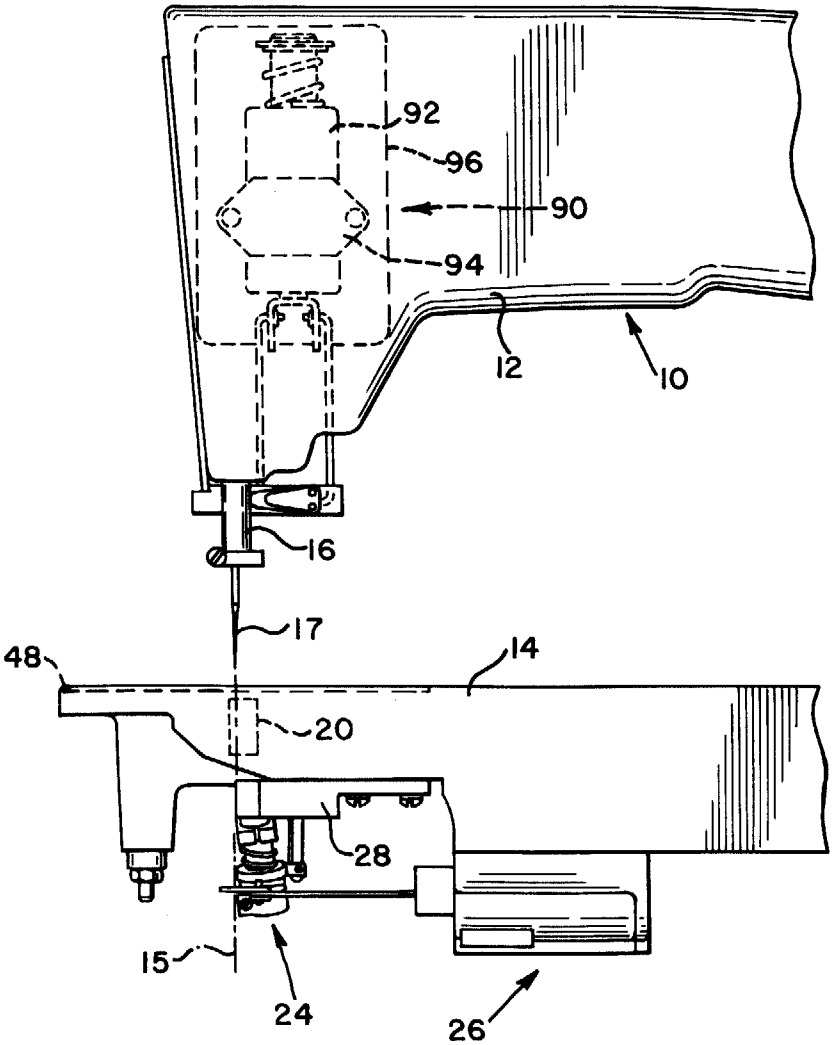
FIG. 1 is a front elevation, parts being broken away showing a lockstitch sewing machine embodying the invention.

Referring now to the drawings and more particularly to FIGS. 1 and 6. The sewing machine 10, in a preferred embodiment, is of the lockstitch type and includes the arm portion 12 and a base portion 14. Carried at the extremity of the arm portion 12 are the needle bar means 16 the presser foot means 18 and the related means whereby they are driven.

Turning to FIG. 6 which is basically a left side view of the base portion 14 of FIG. 1 the rotary hook and its related assemblies 20 are shown generally positioned below the throat plate 22. In general all of the above components associated with the basic machine are conventional and well known in the art.

Figure 9:
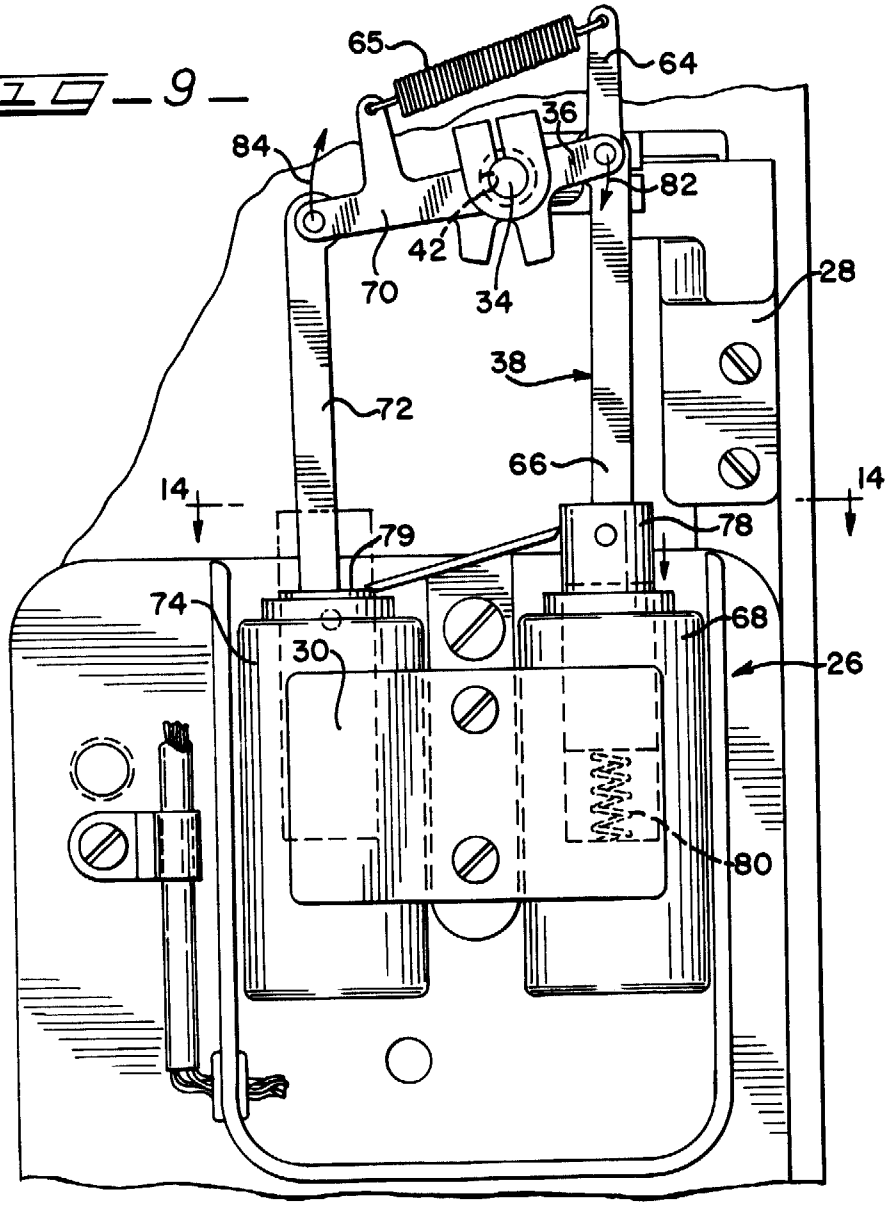
FIG. 9 is a partial bottom view of the driving mechanisms for driving the thread trimmer as shown in FIGS. 7 and 8.

In the practice of the invention in the preferred embodiment as shown in FIGS. 1 and 6 the thread trimmer means 24 is located at a position to the right and forward of, for example, path 15 passing along that swept out by the needle 17. That is the line 15 passed through the major axis of the needle 17 and needle bar means, perpendicular to the throat plate means 22. The thread trimmer means 24 would be found to have its major axis different therefrom by two angles of freedom. An actuation assembly means 26 shown in FIG. 1 and more specifically in FIGS. 9 and 14 is employed to actuate the respective elements during the work cycle. A support means 28 carries the housing means 27 of the forward portion of the thread trimmer means 24. In the preferred embodiment housing means 27 is a sleeve. The support means 28 being in turn secured to the base portion 14. The driving or actuating portion means portion 26 in turn is also secured to the base portion 14 such as by a bracket means 30.

Figure 8:
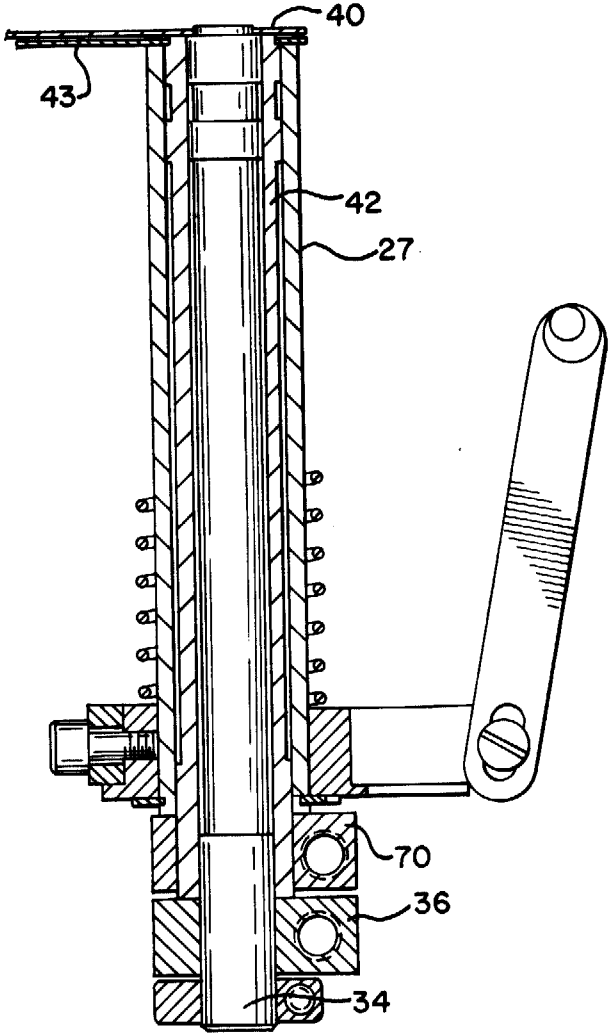
FIG. 8 is a fragmentary cross sectional view of the thread trimmer shown in FIG. 7.

Referring now to the cutter means portion 32 of the thread trimmer means 24 as basically shown in FIG. 7 it will be noted that it is of a generally cylindrical shape having the thread engaging and cutting elements secured thereto. As previously stated the support bracket means 28 secures the housing means 27 of cutter portion means 32 to the frame or casting of the base 14. Referring to FIG. 8 wherein is shown a cross sectional view generally of the cutter portion assembly 32 the particular characteristics thereof become more apparent. Included within the assemblies are a series of hollow tubes journalling one another. In the center of the tubes is a solid shaft means 34 which is secured via a binder clamp 36 to a driving lever means 38 shown in FIG. 9. The shaft means 34 at its end opposite to binder clamp means 36 has secured to it a flat elongated stripper assembly means 40. The shaft means 34 in turn journals a first tube means 42 which is included in the picker assembly. The picker assembly 43 also includes a knife picker means 44. As is apparent upon rotation of shaft means 34 or tube means 42 all means carried thereby also rotate.

The stripper means 40 and the knife picker means 44 are shown in FIGS. 10, 11 and 12 in three of the positions they would pass through during a thread trimming cycle, with respect to the needle hole 46. In these figures it must be appreciated that the throat plate 22 as shown in FIG. 6 would be located in the plane of the paper of FIGS. 10–12. The left side of the throat plate 22 labeled 48 in FIG. 1 for convenience would be on the left side of the needle hole 46. As shown in FIG. 10 the stripper means 40 and picker-knife means 44 are in the rest position. As the assemblage pivots with the shaft 34 to the left as shown in FIG. 1 for example, the stripper 40 and the picker-knife means 44 eventually reach the position shown in FIG. 11. For the sake of explanation the threads have been added into figures 11 and 12. The bobbin thread passes from the sewn garment (not shown) through the needle hole 46 down into the hook assembly 20. The needle thread loop 50 has been spread such that a first leg 52 leads to the garment (not shown) while the second leg 54 leads back up through the needle hole to the needle. The spreading of the needle thread loop, with the selective cutting of a particular leg thereof, is essential to achieve the desired results of this invention. Specifically the bobbin thread 48 and the leg 52 must be cut as close to the needle hole 46 as possible while the remaining leg 54 must be left of a sufficient length such that the next work cycle can be undertaken. As will be hereafter explained, the forward section 56 of stripper 40 and the forward section 58 of knife-picker means 44 have passed from the right of the hook in an arch up and over it and then down to the left of it. As the forward section 58 passed to the left generally over the front edge of the hook assembly 20 it began moving in a downwardly direction in order to enter the needle thread loop and position it as shown in FIG. 11. The forward section 58 includes two prong means 47 and 49 with a space or gap identified as 51 therebetween. As is apparent, prong means 47 is included in picker assembly 43 and is below prong 49 which is a portion of knife-picker means 44. The prong means 49 passes into the needle loop and the body means 59 separates it into the two legs 52 and 54. The body portion 53 separates the bobbin thread in a predetermined manner. The knife portion of the knife-picker means 44 is located along the edge 60 of prong means 49. The location of the forward section 56 of stripper means 40 in FIG. 11 should be noted as being almost directly under the needle hole 46. Referring now to FIG. 12 the picker-knife assembly 44 is being retracted to the right to the rest position while the stripper 40 has remained as shown in FIG. 11 directly adjacent the bottom of the needle hole 46. This action forces both the bobbin thread 48 and the tensioned first needle thread leg 52 against the knife surface 60 causing them to be subjected to a guillotine action sufficient to sever them. It should be noted that the bobbin thread 48 shown in FIG. 11 has been trapped on a hook means 62. As the knife-picker assembly 44 moves to the right as shown in FIG. 12 thread is caused to be withdrawn from the bobbin 20. This withdrawing of thread from the bobbin being necessary to successfully begin the next sewing cycle. After the severing of the thread as shown in FIG. 12 the entire assembly moves back to the right of the hook assembly 20 and to the position shown in FIG. 10.

Referring now to the driving mechanism 26 shown in FIG. 9 employed for actuating the thread cutter 24. As previously stated the shaft 34 which controls the movement of stripper 40 is secured via binder clamp 36 to driver lever 38. The driver lever 38 has a first leg 64 suitable for carrying a spring means 65 and a second leg 66 secured to a reciprocating solenoid means 68.

The knife-picker assembly 44 as previously stated is secured to the tube means 42 which is journaled by the shaft means 34. A binder clamp means 70 via a second driving lever means 72 provides a path whereby a force may be transferred from the second solenoid means 74 to control the movement of the picker-knife assembly 44. Thus, it should be apparent that the movement of the stripper means 40 and knife-picker means 44 as graphically shown in FIGS. 10 through 12 is controlled by the actuation and deactuation of the solenoid means 68 and 74.

The relationship of the driving solenoid 68 and 74 as well as the related link members and binder clamps as shown in FIG. 9 corresponds to a cutter position shown generally in FIG. 10. Upon the actuation of solenoid means 68 the plunger means 78 is drawn inwardly against the spring means 80. This causes the drive lever 38 to pull the binder clamp 36 along a path generally indicated by arrow 82. Since the binder clamp 36 is affixed to shaft 34 which in turn is fixed to stripper means 40 all move as a single unit into the position generally shown in FIG. 11. Because solenoid 74 is inactive at this time the plunger thereof can be freely moved in or out of the housing. The binder clamp assembly 70 is secured to the first leg 64 of driver lever 38 via spring means 65. Thus as binder clamp 36 moves along the path indicated by arrow 82, spring means 65 will urge binder clamp means 70 along the path generally indicated by arrow 84. Thus, even though picker-knife means 44 via tube means 42 is not connected to shaft 34 it will follow the stripper means 40 into the position shown in FIG. 11. The position of the plungers 78 and 79 as shown in FIG. 9 in phantom lines thus reflect the positioning of the knife-picker means 44 and the stripper means 40 as shown in FIG. 11. Upon actuation of solenoid 74 the plunger means 79 therein is immediately withdrawn as shown in solid lines. This motion is transferred along drive link 72 to binder clamp means 70 which moves back along the path of arrow 84. The binder clamp 70, since it is securely fixed to tube 42 and knife-picker assembly 44, causes the immediate movement thereof to the respective positions shown in FIG. 12. Whereas previously stated the cutting of the thread takes place.

Referring now to FIGS. 1 through 5 and to the thread wiper and tension assembly means identified generally as 90. The thread wiper and thread tension assembly 90 is employed to fix the needle thread against movement during a particular portion of the cutting cycle and thereafter to wipe the cut needle thread (second leg 54) upwardly to a position away from the presser foot and throat plate. In this position the second leg 54 of the needle thread is in a most advantageous position to start the next stitch. The tensioning and wiping assembly 90 as shown in FIGS. 1 and 2 includes a solenoid means 92 suitably secured to the arm portion 12 of the machine 10 with, for example, a bracket means 94 (partially shown). A housing means 96 is employed to encapsulate the solenoid 92 in order to keep out dirt, foreign matter, etc. Upon actuation of the solenoid 92 the plunger portion 98 moves downwardly as shown in FIG. 2 against the action of the spring means 100. Secured to the plunger 98 is a shaft means 102 (partially shown) which transmits force therefrom to a yoke assembly 104. The relationship of the solenoid means to the yoke means is adjustable via screw assembly 106. That is by turning the screw assembly 106 the travel of the solenoid can be varied. Pivotally secured to yoke means 104 are first and second actuation rods 108 and 110. First actuation rod means 108 is employed in the wiping assembly 112 which includes, as shown in FIGS. 3 and 4, a bell crank lever means 114, a rod means 116, and a second bell crank means 118. In practice, the actuation rod 108 moves downwardly from the position shown and causes the bell crank 114 to pivot around screw means 120. This causes rod means 116 to be urged to the left which causes the bell crank lever assembly 118 to be pivoted around screw means 122. Since the bell crank lever means 118 includes arm means 124 and thread wiper means 126, it is apparent that the wiper means 126 will be swept through a path. In practice the path taken by the end portion 128 will be through the gap between the raised needle 17 and the throat plate 22 where it intercepts the leg of the needle thread to subject it to sufficient tension to accomplish the cutting action. Upon the return stroke, the needle thread leg 54 is carried back around portion 128 to be retained there in cooperation with retainer means 130.

The second actuation rod means 110, included in the thread tensioning means 117, is secured to a bell crank lever means 132 which is pivoted around screw means 134 and shown in FIGS. 3 and 5. The arm means 136 engages a pin means 138 which is secured to a shaft means 140. The shaft means 140 is carried by suitable bearing means (not shown) whereby it can be easily rotated around its major axis. The shaft means 140 is provided with a cam surface as shown generally at 142 which, upon rotation of shaft 140 around its major axis, comes into contact with bracket 144. Thus, it is apparent that upon the movement of end of arm means 136 of bell crank lever 132 upwardly as actuation lever 110 moves downwardly the cammed surface 142 will engage bracket means 144. In practice the needle thread passes between an immobilizing means 143 which includes cam surface 142 and bracket 144 and only upon the actuation of solenoid 92 is it nipped or secured against movement. The frame portion 111 of the wiping and tensioning assembly 112, 117 respectively is secured by suitable means to the arm 12. The presser bar bushing (not shown) passes through aperture means 113. Thus it is fixed in relation to the needle 17 and its path 15.

In operation the solenoid 92 is actuated which in turn cause both the first and the second actuation rods 108 and 110 to move downwardly. This action, from a consideration of FIG. 13, takes place at the initial stages of the cutting cycle. Thus, the wiper arm 126 moves out and engages the uncut thread just after it has been pinched between cam surface 142 and bracket 144. Thereafter the solenoid 92 is deactivated and the spring 100 returns the plunger to the position shown in FIG. 2. This causes the bell crank lever 114 as shown in FIG. 4 to compress the spring 115 since the wiper 126 is firmly engaged with the uncut needle thread. The timing diagram in FIG. 13 demonstrates that solenoid 92 is deactivated before the actual cutting of the needle thread leg 52. As soon as the needle thread leg 52 is cut, the spring 115 causes the wiper 126 to move back to the position shown in FIG. 4, entrapping the needle thread between the end 128 and the retainer 130. During this time the needle thread leg 54 has been nipped between cam surface 142 and bracket means 144. Upon the initiation of the next sewing cycle, the needle bar as it passes down to create the first stitch strikes another pin means 139, also secured to shaft 140, causing shaft 140 to be rotated back a sufficient amount to disengage cam surface 142 from bracket means 144. Thus, the needle thread can pass freely therebetween to facilitate the sewing cycle.

Referring now to FIG. 13 which shows the sequence of events of the various elements, the thread wiper means 112 and thread tensioning means 117 are actuated shortly after the stripper 40 is actuated. Thus, the needle thread is immobilized such that thread cannot be drawn from the cone. As previously mentioned the knife-picker assembly 44 moves with the stripper in that it is in a deactuated state at this time. The wiper and tensioning means are deactuated after the prong means 49 has moved sufficiently to the left to enter into the needle thread loop. Upon deactuation, the wiper pulls the needle thread loop taut around the body means 59 of the knife-picker assembly as shown in FIG. 11. Once the thread is pulled taut, the knife-picker assembly is actuated and it returns to the right, as shown in FIG. 12, and cuts the bobbin thread 48 and leg 52 of the needle thread that is being held in position below the needle hole by the stripper which is still actuated. During the return movement to the right of the knife-picker assembly, the stripper is deactuated and returns by means of spring 65 to the starting position along with knife-picker assembly. Sufficient overlap of these various cycles being allowed to achieve the desired results.

Other embodiments will occur to those skilled in the art and are within the following claims.

What is claimed is:

1. A thread severing assembly means or use with a sewing machine assembly comprising:

a thread severing means including an actuating means, a cutter means having a housing means, a supporting means securing said housing means to said sewing machine assembly, a stripper means and a picker-knife means carried by said housing means and capable of movement with respect thereto and a means operative for transfering force to said stripper means and said picker-knife means from said actuating means;

a thread tensioning means having an actuating means, means operative for periodically immobilizing a portion of thread means and means operative for transfering force from said actuating means to said immobilizing means; said a thread wiper means having an actuating means, means operative for wiping said thread and means operative for transfering force from said actuating means to said wiping means.

2. A thread severing assembly for a lockstitch sewing machine located generally forward of and to the right of the rotary hook assembly in a noncontacting manner comprising:

a thread severing means including a means for entering the needle thread loop formed by said lockstitch sewing machine during stitch formation thereby;

means for separating the legs of the needle thread loop and a bobbin thread in a predetermined manner;

means for drawing off a predetermined amount of bobbin thread;

means for cutting selective of said threads directly adjacent the needle hole; and means supporting and actuating said thread severing means and having a major axis askew to the needle centerline whereby the thread severing device is driven through a compound angle.

3. A thread severing assembly for a lockstitch sewing machine whose work cycle includes a compound angle which follows a path from a position to the right of the rotary hook, up and over the rotary hook means, then down, comprising:

means for entering the needle thread loop;

means separating the bobbin thread and one leg of the needle thread loop from the other leg of the needle thread loop;

means for cutting the bobbin thread and the one leg of the needle loop during actuation; and actuating means having an axis askew to the needle centerline, for driving the thread severing assembly through a work cycle whereby the needle thread loop is entered after passage over the rotary hook assembly means and when in the downward portion of the path, and the thread cutting is performed during retraction at a point below the needle hole.

4. A thread severing assembly for use with a lockstitch sewing machine comprising:

a thread cutting means;

a thread segregating means;

a means having an askewed axis carrying said cutting means and said segregating means through a first path from the right of the rotary hook assembly means, over said hook assembly means, and down to the left thereof whereby intercepting and segregating the bobbin thread and one leg of the needle thread loop from the other leg of the needle thread loop; and means drawing off bobbin thread and cutting the bobbin thread and one leg of the needle thread loop at a point directly beneath the needle hole along the path back to the initial position.

5. A method of cutting thread during the work cycle of a lockstitch sewing machine comprising the steps of:

passing thread from a bobbin through a needle hole into a workpiece;

passing a needle thread down through the needle hole around the bobbin and back through the needle hole to a workpiece whereby forming a loop;

initially moving a thread severing means from a position to the right of the rotary hook, up over the hook and then downwardly into the needle thread loop and away from the needle hole, separating one leg of the needle thread loop and the bobbin thread from the other leg of the needle thread loop;

moving the thread severing means to a position directly under and adjacent the needle hole; and cutting the bobbin and one leg of the needle thread loop directly adjacent the needle hole and continuing the movement of the thread severing means back to the initial position.

6. The method of cutting thread of claim 5 wherein while moving said thread severing means is included the step of:

securing the needle thread against movement at a point above the throat plate after the step of entering the needle loop and tensioning the needle thread passing through the needle hole.

* * * * *